US011142356B2

(12) United States Patent
Giro Amigo

(10) Patent No.: US 11,142,356 B2
(45) Date of Patent: Oct. 12, 2021

(54) DEVICE AND METHOD FOR ASSISTING IN THE FILLING AND CLOSING OPERATION OF A PACKAGE AND STATION FOR FILLING AND CLOSING A PACKAGE IN A PACKAGING MACHINE WHICH COMPRISES SAID DEVICE

(71) Applicant: Girnet Internacional, S.L., Badalona (ES)

(72) Inventor: Ezequiel Giro Amigo, Badalona (ES)

(73) Assignee: Girnet Internacional, S.L., Badalona (ES)

( * ) Notice: Subject to any disclaimer, the term of this patent is extended or adjusted under 35 U.S.C. 154(b) by 569 days.

(21) Appl. No.: 15/395,065

(22) Filed: Dec. 30, 2016

(65) Prior Publication Data

US 2017/0217608 A1 Aug. 3, 2017

(30) Foreign Application Priority Data

Jan. 28, 2016 (EP) ..... 16382031

(51) Int. Cl.
*B65B 7/08* (2006.01)
*B65B 7/06* (2006.01)
(Continued)

(52) U.S. Cl.
CPC ..... *B65B 7/08* (2013.01); *B65B 7/06* (2013.01); *B65B 25/048* (2013.01); *B65B 43/30* (2013.01); *B65B 65/02* (2013.01)

(58) Field of Classification Search
CPC .... B65B 7/06; B65B 7/08; B65B 7/02; B65B 25/48; B65B 40/30; B65B 43/26;
(Continued)

(56) References Cited

U.S. PATENT DOCUMENTS 574,137 A * 12/1896 Cummings ..... B65B 7/06
53/373.6
1,851,676 A * 3/1932 Litchfield ..... B65B 7/06
227/64

(Continued)

FOREIGN PATENT DOCUMENTS

CA 2 352 944 A1 1/2003
CA 2352944 A1 * 1/2003 ..... B65B 7/04

(Continued)

OTHER PUBLICATIONS

European Search Report for EP 16 38 2031 dated Jun. 24, 2016.

*Primary Examiner* — Thanh K Truong
*Assistant Examiner* — Scott A Howell
(74) *Attorney, Agent, or Firm* — Sughrue Mion, PLLC

(57) ABSTRACT

Method for filling and closing a package including the operations of introducing two arms through the mouth, each one having or bearing a gripping tool and impressing a mutual distancing movement on the arms to expand the package with a retention mechanism which operates outside the package to grasp the walls of the package arranged between the arms and the retention mechanism while the retention mechanism approaches and fits over the gripping tool of each arm, such that when the arms move in the direction of the mouth of the package, the arms carry the grasped walls of the package to produce folds towards the interior of the package. For flexible tubular net packages, the at least one gripping tool on each arm has the shape of a protuberance and that the method includes passing through a wall of the package with the gripping tool.

18 Claims, 11 Drawing Sheets

(51) Int. Cl.
*B65B 25/04* (2006.01)
*B65B 43/30* (2006.01)
*B65B 65/02* (2006.01)

(58) Field of Classification Search
CPC ..... B65B 65/02; B65B 43/30; B65B 25/048; B65B 25/04; B65B 65/04; B65B 65/048
USPC .... 53/459, 384.1, 284.7, 469, 570; 493/257, 493/259, 278, 282, 243, 449, 254, 308, 493/258, 263, 457, 458, 459, 570, 284.7
See application file for complete search history.

(56) References Cited

U.S. PATENT DOCUMENTS 2,115,176 A * 4/1938 Pierson ..... B65B 7/06 250/206
2,624,995 A * 1/1953 Allen ..... B65B 7/06 53/370.6
3,657,856 A * 4/1972 Planner ..... A61F 13/15747 28/121
3,869,065 A * 3/1975 Wang ..... B65B 67/1227 221/40
3,949,536 A * 4/1976 Chevalier ..... B65B 7/06 53/570
4,079,662 A * 3/1978 Puccetti ..... B65B 9/2014 493/203
4,214,417 A * 7/1980 Lieder ..... B65B 7/06 53/373.6
4,322,932 A * 4/1982 McGregor ..... B65B 39/08 53/284.7
4,432,186 A * 2/1984 McGregor ..... B65B 39/08 141/114
4,514,962 A * 5/1985 Ausnit ..... B65B 39/02 383/35
4,579,154 A * 4/1986 Muller ..... B65B 39/08 141/114
4,982,557 A * 1/1991 Gradwohl ..... B65B 7/06 53/370.6
5,301,492 A * 4/1994 Kader ..... B65B 39/08 53/384.1
5,305,579 A * 4/1994 Kader ..... B65B 43/30 53/384.1
5,442,898 A * 8/1995 Gabree ..... B65B 37/04 53/385.1
5,768,863 A * 6/1998 McGregor ..... B65B 7/06 141/114
5,802,817 A * 9/1998 Hood ..... B65B 43/16 53/385.1
5,819,511 A * 10/1998 Schlosser ..... B65B 43/16 53/573
5,957,823 A * 9/1999 Fan ..... B31B 70/00 493/248
6,019,713 A * 2/2000 Scypinski ..... B31B 70/00 493/248
6,138,723 A * 10/2000 Wagner ..... B65B 43/465 141/114
6,145,282 A * 11/2000 Tsuruta ..... B29C 65/18 53/551
6,363,694 B1 * 4/2002 Riedinger ..... B65B 43/36 53/459
6,432,033 B1 * 8/2002 Salzmann ..... B60R 21/237 280/728.1
6,955,195 B1 * 10/2005 Marceau ..... B65B 1/06 141/10
7,100,658 B2 * 9/2006 Giro Amigo ..... B65B 5/022 156/496
7,354,387 B2 * 4/2008 Giro Amigo ..... B65B 7/06 493/243
7,421,834 B1 * 9/2008 Doolan ..... B65B 1/366 53/570
7,568,328 B2 * 8/2009 Imao ..... B65B 5/045 53/284.7
7,624,773 B2 * 12/2009 Maxwell ..... B65B 5/067 141/114
7,780,589 B2 * 8/2010 Giro Amigo ..... B65D 29/04 493/248
7,877,966 B2 * 2/2011 Knoke ..... B65B 1/36 53/451
8,562,274 B2 * 10/2013 Murray ..... B65B 39/02 414/222.02
8,943,783 B2 * 2/2015 Ouellet ..... B65B 43/46 53/138.7
8,959,880 B2 * 2/2015 Morand ..... B65B 67/1222 206/303
9,617,021 B2 * 4/2017 McCorkle ..... B65B 5/045
2006/0204150 A1 * 9/2006 Giro Amigo ..... B65D 29/04 383/117
2008/0098697 A1 * 5/2008 Murray ..... B65D 75/5883 53/457
2009/0241474 A1 * 10/2009 Actis ..... B65B 5/045 53/456
2011/0138751 A1 * 6/2011 Nakagawa ..... B65B 43/50 53/469
2015/0291296 A1 * 10/2015 Lorger ..... B65B 43/465 53/459
2016/0075098 A1 * 3/2016 Link ..... B65B 51/00 493/311
2016/0278295 A1 * 9/2016 Johnson ..... A01F 25/14

FOREIGN PATENT DOCUMENTS

DE 3727504 C1 * 1/1989 ..... B65B 7/08
EP 1481899 A1 * 12/2004 ..... B65B 5/022
EP 1 688 351 A2 8/2006
EP 2028106 A2 * 2/2009 ..... B65B 7/06
GB 2055742 A * 3/1981 ..... B65B 7/06

* cited by examiner

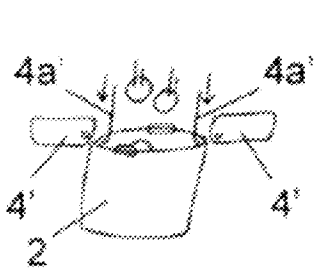
Fig. 1a
Fig. 1b
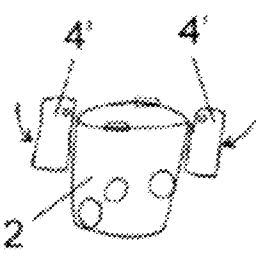
Fig. 1c
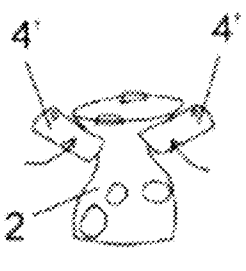
Fig. 1d
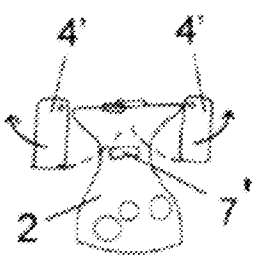
Fig. 1e
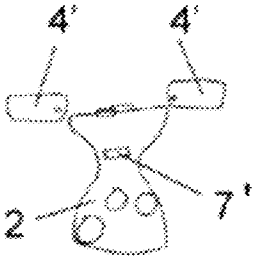
Fig. 1f
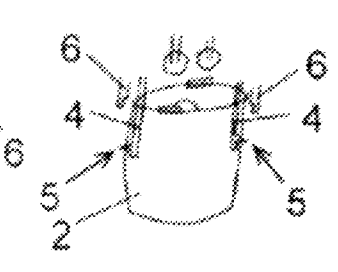
Fig. 2a
Fig. 2b
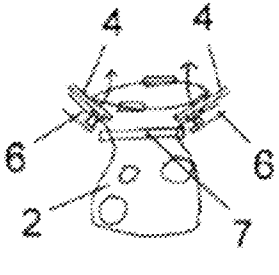
Fig. 2c
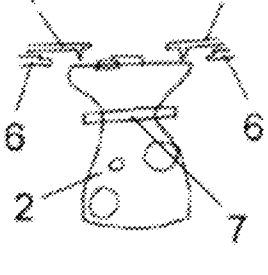
Fig. 2d

DEVICE AND METHOD FOR ASSISTING IN THE FILLING AND CLOSING OPERATION OF A PACKAGE AND STATION FOR FILLING AND CLOSING A PACKAGE IN A PACKAGING MACHINE WHICH COMPRISES SAID DEVICE

TECHNICAL SECTOR OF THE INVENTION

The invention relates to a device and to a method for assisting in the filling and closing operation of a package capable of producing folds in the package towards the interior thereof during the closing of the same. The invention also relates to a station for filling and closing a package in a packaging machine, which uses said device.

BACKGROUND OF THE INVENTION

In the scope of packaging machines for horticultural products in flexible tubular packages, such as net bags, machines are known which comprise an automatic filling station equipped with holding clamps, which hold the package to be filled in suspension by the upper mouth thereof while the filling of the packages is carried out. Once the package has been filled, the package is closed, which usually comprises the step of joining together the clamps which hold the package, preparing it so that in a subsequent station in the same machine, the opposite walls of the package in the area of the upper mouth thereof are joined together, for example by heat welding.

With the aim of ensuring an optimal closure of the package, the machines are provided with a device, which enables the formation of folds in the laterals of the package when the closure thereof is carried out.

These devices use feeder means which push, from outside the package, portions of the package towards the interior thereof. These feeders condition the arrangement and measurements of other components of the filling station since, for example they cannot interfere with the clamps which hold the package during the filling and closing thereof nor with the transfer means which are responsible for holding the package once it is closed and transporting it to the following station in the packaging machine, traditionally the station in which the package is finally closed.

The patent document EP1688351 A2 describes a folding device applicable to the closure of flexible tubular packages, such as for example net bags, as previously described. Said device comprises two groups of rotary blades arranged opposing, adapted for rotating simultaneously and so that each blade of the same group acts from outside the package and pushes respective portions of a lateral of the package inwards. In this case, more than one fold is produced in each lateral of the package and the blades of the same group are capable of approaching each other so that the clamps that hold the package in a suspended manner can approach each other during the closure operation of the package.

The blades of each group are pulled in the rotary movement thereof by the same axis of rotation, such that the blades of the same group are capable of swiveling, simultaneously and alternately, first in the direction to the package to be closed and subsequently in an opposing direction in each operative cycle of the device and the drive axes of the two groups of blades are parallel and are arranged at the same height.

More specifically, the blades depart from an initial, practically horizontal position so as not to interfere with the delivery path of a package to be processed in the filling station; they rotate until meeting and push the walls of the package inwards during the folding operation; and necessarily rotate again in the opposite direction to the initial position thereof when the package is closed so as not to interfere with the transport path of the package towards the subsequent station of the machine.

A way of proceeding alternative to the known way is an objective of the invention. A device that offers an alternative to the known folding devices is therefore an objective of the invention.

A more efficient method and device are also an objective of the invention, which allow the rate of the machine to increase, that is to say that the number of packages filled and closed per unit of time can be increased, the corresponding folds in the package having been formed.

As it has been previously put forward, the known feeders condition the configuration of other components of the filling station. In the specific example of the device described in EP1688351 A2, the return movement of the blades from the position in which they form the folds in the package, pushing the lateral walls of the package towards the interior of the same, towards the original position thereof, can interfere with the transfer means of the package to the subsequent station of the packaging machine, formed by a pair of plates which at each side of the package approach each other to crush and hold the flattened package under pressure. The situation arises where it is of interest for the plates to act on the package at the level of the folds in order to guarantee that these do not become undone during the transfer of the package and during the final closing operation of the same, however, this condition cannot be satisfactorily met if the mechanical interference with the movement of the blades in the return path thereof is desired to be overcome.

A method and a device are therefore also an objective of the invention, which improve this situation, specifically, which allow an improved holding of the package for the transfer thereof to the subsequent work station in the packaging machine, ensuring that the folds formed do not become undone or lose the original shape thereof.

In the filling station, it is also known that the products to be stored in the packages are poured through a filling tube, the outlet thereof being pointed at the mouth of the package, which is held suspended and open. In order to ensure that said mouth is open as far as possible during the filling of the package the filling stations are equipped with means for assisting the clamps that hold the package by the mouth thereof in order to maintain the package expanded, with the mouth thereof open as far as possible.

A method and a device are also objectives of the invention, which provide an alternative to this manner of manipulating the package, that is, an alternative to the manner currently used for expanding the package during the filling operation.

DESCRIPTION OF THE INVENTION

With the aim of providing a solution to the problems set out, a device is made known for assisting in the filling and closing operation of a package, especially for flexible tubular net packages, which comprises two drive units arranged opposed and adapted for receiving an empty package therebetween. Each unit comprises at least one movable arm and an actuator group capable of moving the arm in a first direction of movement from an initial position which does not interfere with the receipt of the package to a position in which the distal ends of the arms are introduced by way of the mouth of the package and they push the walls of the same outwards to expand it with the first objective of facilitating the filling operation, each arm having or bearing on said distal end at least one gripping tool suitable for passing through a hole of the net and each arm being equipped with retention means capable of being moved between a release position distanced from the gripping tool and a captive position in which they fit over said gripping tool, being able to capture or grasp the portion of the net passed through by the tool, the actuator group being capable of moving the arm in a second direction of movement inverse to the first, the retention means adopting the captive position thereof, a movement which allows the captured portions of net to be pulled towards the interior part of the package with the second objective of forming respective lateral folds intended to facilitate the correct closure of the package.

According to the invention, the arms, which produce the folds in the package, act from inside the same instead of from outside.

In this way, it is not necessary for the arms to carry out a return movement once the folds have been formed or move in the opposite direction to that which produces the folds in the package, as occurred with the devices known in the state of the art, but once the folds have been implemented, said arms could continue being moved in the direction of the mouth of the package, prior to the release of the walls of the same, the retention means being arranged in the release position thereof until readopting the initial position.

It should be pointed out that this ascending path of the arms avoids the mechanical interferences with other components of the device or of the packaging machine, such as the means for transferring the package to the subsequent station of the machine, generally formed by a pair of plates which at each side of the package approach each other to crush and hold the flattened package under pressure. This allows said transfer means to be arranged at a level closer to the mouth of the package and they can have greater dimensions, which aids an improved hold of the package for the transfer thereof to the subsequent work station in the packaging machine, ensuring that the folds formed do not become undone or lose the original shape thereof.

In addition, there is no free movement of the arms since they carry out a first objective, when they are moved in order to arrange the ends thereof in the interior of the package, which is to expand the package; and a second objective when they are moved in reverse, which is to produce the folds in the package.

This means that they utilize all the displacements of the arms since the folds in the package are carried out by using the same arms which have cooperated in the expansion of the package without the need to use other independent auxiliary means to expand the package as is the case with the devices known in the state of the art.

Additionally, the angle of rotation of the arms is much less than that which the rotating blade known in the state of the art require, which allows execution times for the operations carried out to be economized and as a result the rate of the filling station in a packaging machine is increased.

According to a preferred embodiment, the at least one gripping tool is configured in the manner of a protuberance capable of passing through a hole of the net. Preferably, the protuberance has a rod or sharp pin shape.

Advantageously, the retention means comprise a piece mounted adjacent to the arm and longitudinally displaceable with respect to the arm according to a linear movement between the release position, distanced from the gripping tool of the arm and the captive position in which the piece fits on said gripping tool to capture or grasp a portion of the net and vice versa.

Preferably, the piece has a retention end, intended to cooperate with the tool for retaining a net portion, equipped with an indentation or depression in which the tool of the associated arm is at least partially introduced when the piece adopts the captive position.

The retention means are actuated by means of an actuator, preferably electric or pneumatic, inseparable from the associated arm.

Preferably, the actuator comprises a transmission of the rack and pinion type.

According to one embodiment of the invention, the arm or arms of each drive unit are mounted on a rotating axis around an axis of rotation such that the arm or arms of the same unit are capable of swiveling around said axes of rotation simultaneously in the first and in the second directions of movement of each operative cycle of the device, the axes of rotation of both units being parallel.

Preferably, the rotary axes are displaceably supported, but in a guided manner, on each drive unit by mechanical support on a guide or surface of a cam, the rotation of the axis being precisely that which causes the displacement thereof on the guide or over the cam, all of which in a manner which can impress a composite movement on the arms, specifically rotating around an axis which is displaced.

This allows for the same device to be more versatile, specifically for the same set of arms to be able to be adapted to different sizes of packages.

In one embodiment, a cam mounted inseparable in movement with the rotary axis of the arms of each unit is used, said cam being equipped with a sliding guide displaceable on a tracking element fixed to the structure of the device or filling and closing station such that the rotation of the rotary axis causes the displacement of the cam by way of the guide thereof on the tracking element, which in turn produces a translation movement of the rotary axis.

Preferably, each drive unit comprises two arms coupled to the respective rotary axis with the capacity to displace along a section of the cited rotary axis, both arms being capable of being displaced simultaneously in opposing directions, approaching and moving away from each other, in each operative cycle of the device.

Additionally, the two arms of the same drive unit are connected to each other by means of an element with elastic properties which acts under compression such that, departing from an initial position in which the arms of the same unit are separated a predetermined distance, if these are actively pulled in opposite directions, approaching each other, the element with elastic properties is compressed and once said pulling force ceases to be exerted on the arms, both arms are automatically separated as the element with elastic properties tends to recover the original shape thereof.

According to another aspect of the invention, a method is made known for the filling and closing of a package, in particular for flexible tubular net packages, which maintaining the package held suspended by the upper open mouth thereof, comprises the following operations:

a) introducing through the mouth thereof at least two arms each one bearing at least one gripping tool and impressing on them a mutual distancing movement to expand the package;
b) depositing products in the interior of the package by way of the mouth thereof;
c) using retention means which operate outside of the package, grasping the walls of the package arranged between the arms and the cited retention means when said retention means approach and fit over the gripping tool of each arm;

d) moving the arms in the direction of the mouth of the package, bringing with them the grasped walls of the package to produce folds towards the interior of the package;

e) closing the package, flattening the upper mouth thereof and pleating the folds produced in order to prevent the latter from becoming undone.

Advantageously, the at least one gripping tool has the form of a protuberance and the method comprises passing through a wall of the package, where appropriate, a hole of the net, with said gripping tool.

Also advantageously, the method comprises the operation of releasing the walls of the package grasped in the operation c) separating the retention means from the gripping tool of each arm prior to proceeding to the operation of removing the arms from the package.

The invention also relates to a station for filling and closing a package in a packaging machine, especially for flexible net packages which comprises a device like that previously mentioned; and a pair of holding clamps configured for holding an empty package suspended, said clamps being capable of approaching or moving away from each in order to cooperate in a synchronized manner with the movable arms of both units of the device in the operations of filling the package and subsequently closing the upper edge thereof, the station also comprising transfer means with two pressing plates arranged one at each side of the package actuatable in order to approach each other and adopt a transfer position, in which they grasp the package, flattening it transversally, joining opposing walls of the same, preventing the lateral folds formed in the cited package becoming undone and in order to be displaced together and thus transport the grasped package to a contiguous station of the machine, said pressing plates being placed and dimensioned such that in the transfer position they interfere with the path of the arms from the initial position thereof until the position in which, introduced in the package, they push the walls of the same to expand it.

Preferably, the station is equipped with a tube for pouring products with an outlet hole and is provided with foldable deflectors suited for directing the products poured through the outlet of the tube towards the mouth of the package, each deflector being formed by a wing of flexible material which is rigidized with a rigid material core which extends in a direction parallel to that of the arms of each drive unit of the device.

The fact that foldable deflectors provided with flexible material wings are used allows the products to be effectively directed towards the interior of the package without damaging them and circumventing the mechanical interference thereof with the arms of the device when the deflectors are unfolded.

BRIEF DESCRIPTION OF THE DRAWINGS

FIGS. 1*a* to 1*f* schematically show a sequence of the operations which are carried out when feeder means are used which operate from the exterior of the package to produce folds at both sides of the package during the filling and closing thereof which is representative of the state of the art;

FIGS. 2*a* to 2*d* schematically show a sequence of the operations which are carried out following the method according to one variant of the invention;

FIGS. 5*a* to 9*a* and FIGS. 5*b* to 9*b* are respectively perspective views and profile views of a drive unit provided with two arms, showing different positions of the arms and of the retention means with respect to the gripping tool;

DETAILED DESCRIPTION OF THE INVENTION

Figure 3:
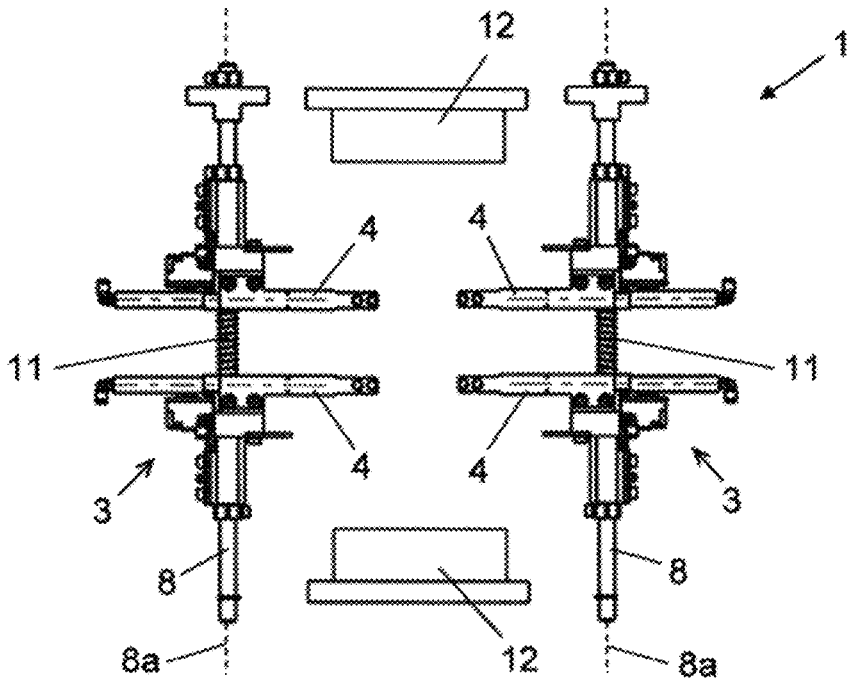
FIG. 3 is a schematic plan view of the device according to one embodiment of the invention in which each drive unit is provided with two arms, showing the initial position for receiving an empty package.

The sequences of FIGS. 1*a* to 1*f* and 2*a* to 2*d* show different methods to be followed in order to implement folds in a package 2 held suspended by the upper mouth thereof in a filling and closing station for packages in a packaging machine.

The sequence of FIGS. 1*a* to 1*f* show a method known in the state of the art which uses feeders in the form of rotary blades 4' which act from outside the package 2.

In each working cycle of the station, the rotary blades 4' adopt an essentially horizontally starting position, shown in FIG. 1*a* which does not interfere with the horizontal path for introducing the package into the station.

The station should be equipped with means 4*a*' suitable for cooperating in the expansion of the package 2 during the filling operation, the rotary blades 4' remaining at a distance from the package 2, as FIG. 1*b* shows.

The folds can then be implemented in the package 2, using the rotary blades 4'. In order to carry out the function thereof, said rotary blades 4' should rotate freely around the axes thereof an angle notably greater than 90° until adopting an operative position in which the ends thereof push the walls of the package 2 inwards, whereby it is necessary for said blades 4' to have the ends thereof below the vertical projection of the mouth of the package 2, all of which as FIGS. 1*c* and 1*d* show.

The package 2 can then be provisionally closed by approximating the walls of the same on the upper mouth thereof and the package 2 can be held by transfer means, schematically illustrated in the sequence, which use plates 7' which act one at each side of the package 2, approaching each other in order to flatten it, pleating the lateral folds previously formed and holding it under pressure between plates 7'. However, note that the rotary blades 4' should carry out a return movement, rotating around the axes thereof in a direction contrary to that of the folding direction, which cannot interfere with the transfer means 7' as FIG. 1*e* illustrates. Additionally, the means 4*a*' which cooperate to maintain the package 2 expanded should be withdrawn so as not to interfere with the closing of the package 2.

This free return movement of the rotary blades 4' is again notably greater than 90° until reaching the original starting position so as not to interfere with the transfer path of the filled package 2 to a subsequent station in the machine or with the path of a new package 2 to be filled which will be introduced into the filling station.

The sequence of FIGS. 2*a* to 2*d* shows an alternative method for proceeding according to a variant of the present invention, which uses movable arms 4 which act from within the package 2.

In each working cycle of the station, these arms 4 adopt an essentially horizontal starting position, shown in FIG. 2*a*, which does not interfere with the horizontal path for introducing the package 2 into the station.

These arms 4 are moved in order to introduce the ends thereof into the package 2 by way of the mouth thereof and to push the walls of the same outwards with the first objective of cooperating with the expansion of the package 2 during the filling operation, as FIG. 2*b* shows.

In order to carry out this first objective, the arms 4, in the movement thereof, should rotate an angle of approximately 90° until adopting a first operative position illustrated in said FIG. 2*b*.

The folds in the package 2 can then be implemented, using the same arms 4 which have cooperated in the expansion of the package 2. For such purpose, the arms 4 bear a gripping tool 5 and retention means 6 are used which operate outside of the package 2 and which grasp the walls of the package 2 arranged between the arms 4, which remain introduced in the package 2, and the cited retention means 6 while said retention means 6 approach and fit over the gripping tool 5 of each arm 4, then the arms 4 being moved towards the interior of the package 2 and towards the mouth of the same, bringing with them the grasped walls of the package 2 in order to produce both folds towards the interior of the package 2, as FIG. 2*c* illustrates. In order to implement this second objective, that of folding, the arms 4 should rotate at least 90° with respect to the position which they adopt during the expansion and filling of the package 2.

In the illustrated variant, suited for net packages, the arms 4 bear, on the distal ends thereof at least one gripping tool 5 in the form of a protuberance capable of passing through a hole of the net and the retention means 6 are mounted on the arms 4 and consequently are moved together with the arms 4, being capable of being moved also with respect to the arms 4 between a release position distanced from the gripping tool 5 and a captive position in which they fit over said gripping tool 5, being able to capture or grasp the portion of the net passed through by the tool 5, all of which as is described in detail below.

Subsequent to the formation of the folds, the package 2 can be provisionally closed approximating the walls of the same on the upper mouth thereof and the package 2 can be held by the transfer means, schematically illustrated in the sequence, which use plates 7 which act one at each side of the package 2, approaching each other to flatten it, pleating the lateral folds before previously formed and holding it under pressure between the plates 7. However, note that the arms 4 should now not carry out a return movement or be moved in a direction contrary to that which causes the folds in the package 2, but the arms 4 continue moving in a direction to the mouth of the package 2, prior to the release from the walls of the same until adopting the initial position again as FIG. 2*d* illustrates.

The mentioned release of the walls of the package 2 is achieved by arranging the retention means 6 in the release position thereof, distanced from the gripping tool 5, which is the position which they originally adopt and which FIGS. 2*a* and 2*d* illustrate.

It should be noted that as the arms 4 follow a movement with an ascending path, the mechanical interferences with the plates 7 of the transfer means are avoided, said plates can be arranged at a level closer to the mouth of the package 2 and can have greater dimensions, which contributes to an improved hold and to maintaining the folds in the desired shape during the transfer of the package 2.

Note that there is practically no free movement of the arms 4, since these perform a first objective when they are moved in order to arrange the ends thereof in the interior of the package 2, which is to expand the package 2; and a second objective when they are moved in reverse which is to produce the folds in the package 2. This means that they utilize all the displacements of the arms 4 and that independent auxiliary means are not required to expand the package 2 as is the case with the method of FIGS. 1*a* to 1*f*.

Similarly, the angle of rotation of the arms 4 is much smaller than that which the rotary blades 4' require from the example of FIGS. 1*a* to 1*f*, which economizes the execution times of the operations carried out.

As is detailed below, the invention also envisaged that the arms 4 can carry out a composite movement, not strictly rotating around a fixed axis of rotation. For such purpose, it is envisaged that the arms 4 rotate around both axes, but that these are displaceably mounted in a guided manner on the structure or chassis of the device or of the station. This allows the same device 1 to be more versatile specifically that the same set of arms 4 can be adapted to different sizes of packages 2.

The method according to FIGS. 2*a* to 2*d* is also compatible with other needs, which can arise in a folding operation such as the need to have to carry out more than one fold at each side of a package 2. Thus, as is also described below, it is envisaged that the device 1 used comprises two drive units 3 each one with two arms 4 mounted on a common rotary axis 8, but with the capacity to approach or move away from each other, in order to not obstruct the provisional closing operation of the packages 2.

The arms 4 can each bear one or more gripping tools 5 and the shape of the retention means 6, especially of the part, which should fit over the gripping tool or the gripping tools 5, can also vary.

The gripping tool 5 or, where appropriate, the gripping tools, if there is more than one, can be formed on the arm 4 or can be formed by pieces originally separated and subsequently joined to the same, preferably in a firm manner, for example, by welding, but other forms of joining are also considered such that they allow the gripping tool or tools to be replaced. In the case of the gripping tool 5 being formed on the arm, it is, for example considered that the arm has at the distal end thereof a portion folded or bent at an angle, conveniently mechanized in order to give it the optimal shape and it is this bent portion which carries out the function of the gripping tool.

Below a preferred exemplary embodiment of the device 1 of the invention is described which comprises two drive units 3 arranged opposed and adapted for receiving with respect to each other an empty package 2, each unit 3 being provided with two arms 4, as can be observed, for example in FIG. 3.

In said FIG. 3, a view is depicted from above of both drive units 3 with the arms 4 arranged in an essentially horizontal starting position, which corresponds to the profile view shown in FIG. 2*a*, the position thereof not interfering with the horizontal reception path of an empty package 2 (not shown). Furthermore, a pair of holding clamps 12 belonging to the filling and closing station 100 is shown (see FIG. 13) configured such that they can hold an empty package 2 suspended, said clamps 12 being capable of approaching and moving away from each other in order to cooperate in a synchronized manner with the movable arms 4 of both units 3, as is described below.

The two arms 4 of each unit 3 are mounted on a rotary axis 8 around an axis of rotation 8*a* such that the arms 4 of the same unit 3 are capable of swiveling around said axes of rotation 8*a* simultaneously in first and second opposite directions of movement in each operative cycle of the device 1. Furthermore, the rotary axes 8 of both units 3 are parallel and are actuated by both actuator groups 4*a* (see FIGS. 12*a*, 12*b* and 13), for example of the type which each comprise an electric motor.

In addition, the two arms 4 of each unit 3 are coupled to the respective rotary axis 8 with the capacity to displace along a section of the cited rotary axis 8, both arms 4 being capable of being displaced simultaneously in opposing directions, approaching and moving away from each other in each operative cycle of the device by the action of said holding clamps 12.

Figure 4:
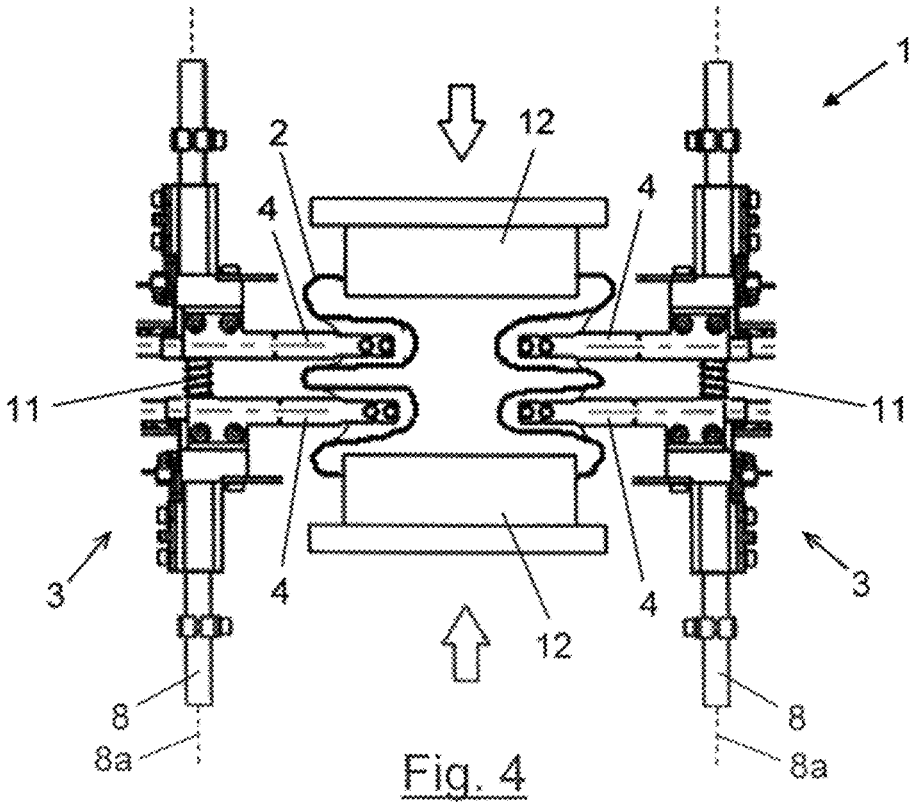
FIG. 4 is a schematic view analogous to FIG. 3 showing a fictitious position in which the arms have acted to form the folds in the package, and in which the holding clamps of the mouth of the package have been approximated with respect to each other so as not to interfere with the provisional closing of said package.

FIG. 4 shows a fictitious position similar to FIG. 2*c* in which the formation of the folds in the package 2 created between the pairs of arms 4 of each unit 3 can be observed, and in which the holding clamps 12 are actuated approximating each other and in turn pulling the respective arms 4 of each unit 3 in order to allow the provisional closing of the package 2.

Additionally, the arms 4 of the same unit 3 are connected by means of an element 11 with elastic properties, such as a helical spring which works under compression such that once the clamps 12 cease exerting the pulling force on the arms 4, both arms 4 of each unit 3 are automatically separated when said element 11 with elastic properties tends to recover the original shape thereof, allowing the return of the pairs of arms 4 to the initial position thereof (see FIG. 3).

In the case of this embodiment with two arms 4 on each drive unit 3, the method for the filling and closing of a package is thus similar to that described in FIGS. 2*a* to 2*d*, as is shown below in FIGS. 5*a* to 9*b*.

Figure 5A:
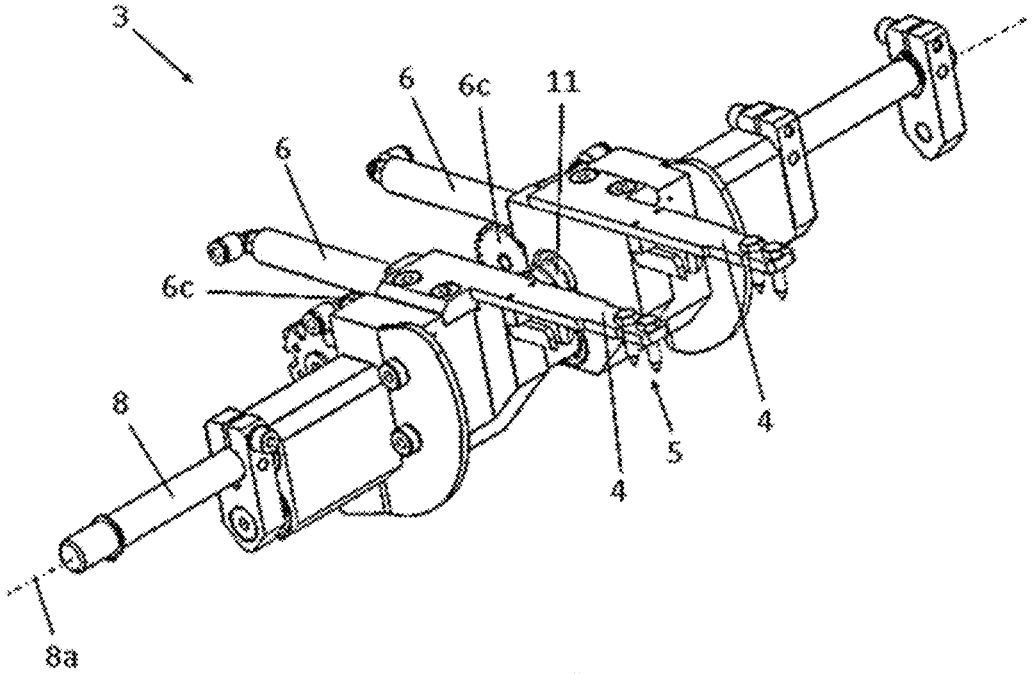
Figure 5B:
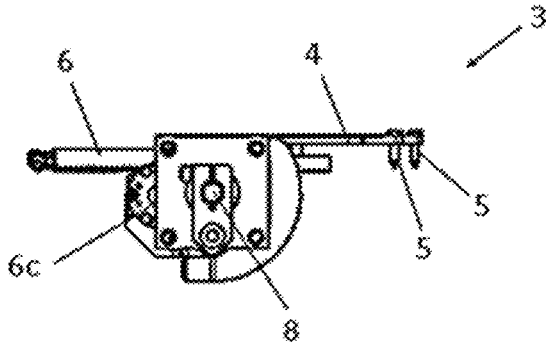

In FIGS. 5*a* and 5*b*, a drive unit 3 can be observed provided with two arms 4 in the initial position, analogous to FIG. 2*a*, in which the arms 4 adopt an essentially horizontal position, which does not interfere with the horizontal reception path of an empty package 2.

Figure 6A:
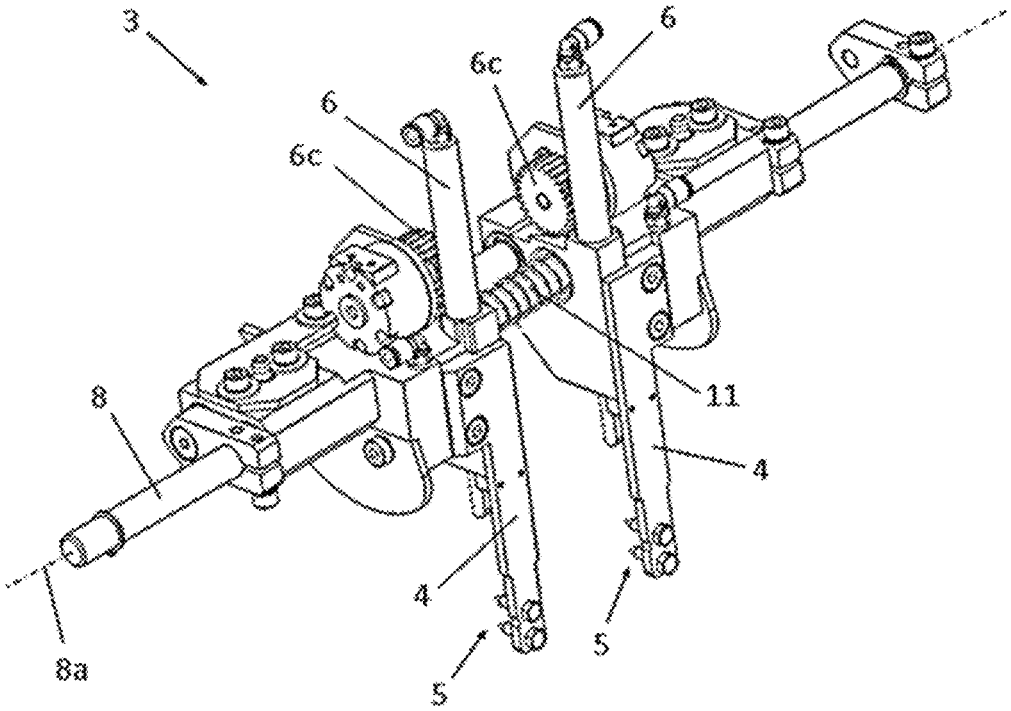
Figure 6B:
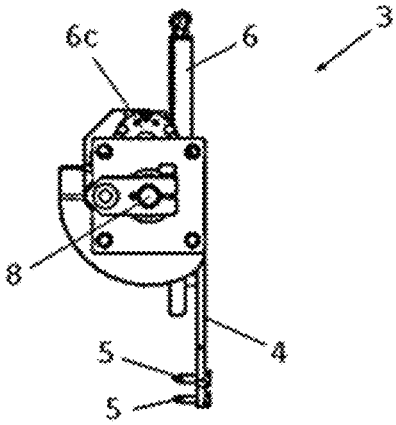

In FIGS. 6*a* and 6*b*, the position is shown in which said arms 4 have rotated an angle of approximately 90° until adopting a position analogous to that of FIG. 2*b* such that the ends thereof have been introduced into the package 2 by way of the mouth thereof and push the walls of the same outwards with the first objective of cooperating with the expansion of the package 2 during the filling operation.

As has been mentioned, each arm 4 bears at the distal end thereof at least one gripping tool 5 suitable for passing through a hole of the net of the package 2. In this example, two tools 5 are depicted with the shape of a sharp protuberance.

Figure 7A:
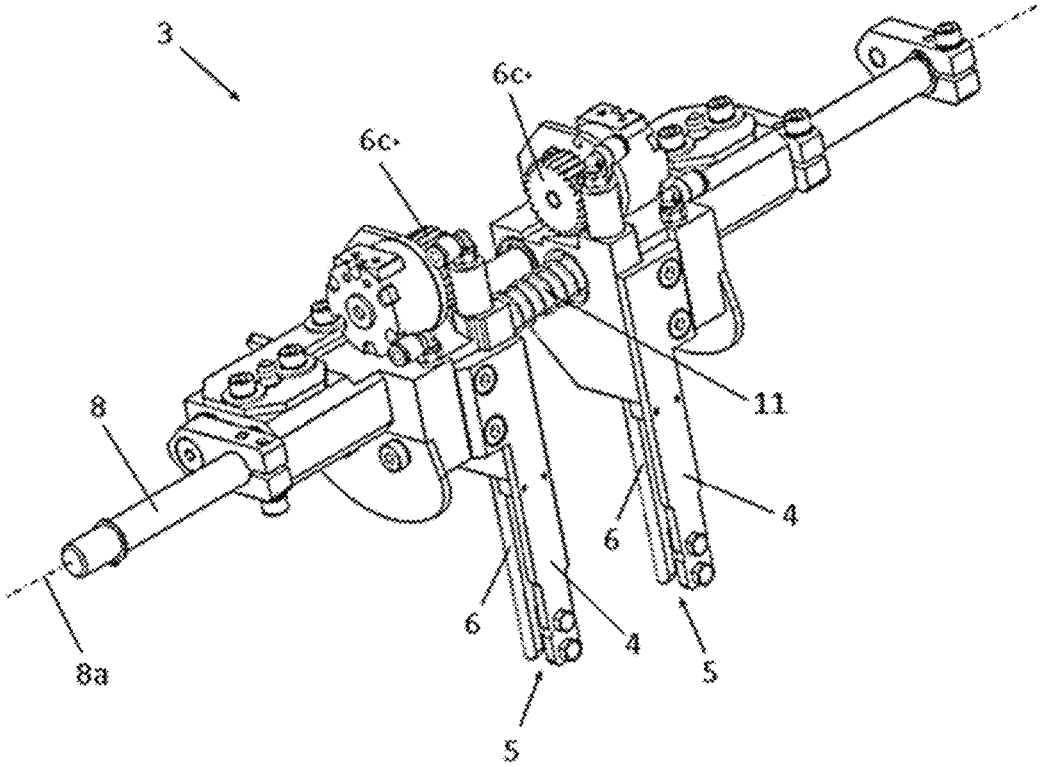
Figure 7B:
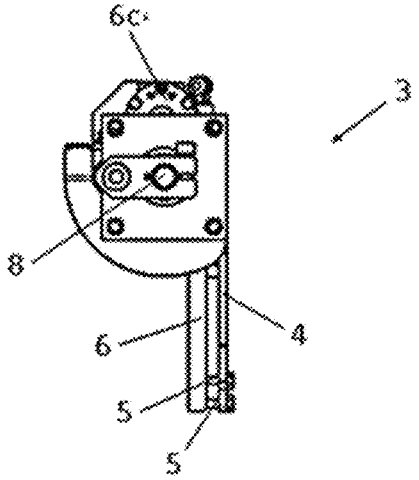

Furthermore, each arm 4 is equipped with retention means 6 capable of being moved between a release position distanced from the gripping tools 5 shown in FIGS. 6*a* and 6*b* and a captive position shown in FIGS. 7*a* and 7*b* in which they fit over said gripping tools 5 to capture or grasp the portion of the net passed through by the tools 5.

Figure 8A:
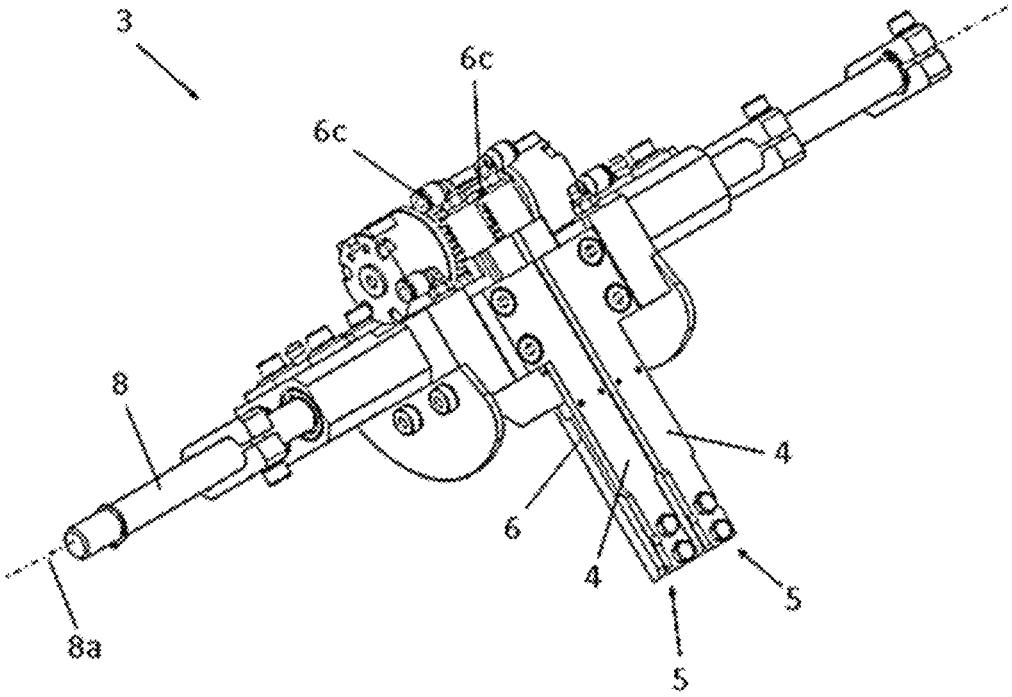
Figure 8B:
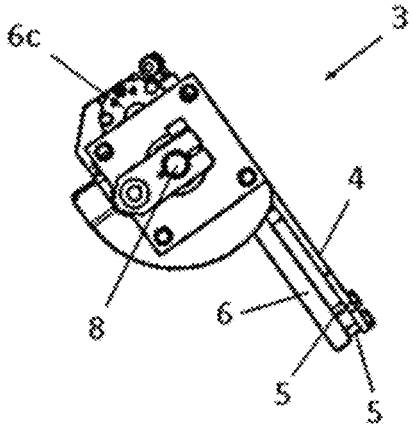

In FIGS. 8*a* and 8*b*, a position is shown, similar to that of FIG. 2*c* in which the arms 4 with the retention means 6 arranged in the captive position have started to rotate in the inverse direction to the first with the aim of pulling the captured portions of net towards the interior part of the package to implement the formation of the lateral folds.

Furthermore, it is observed that the arms 4 are together due to the pulling action of the holding clamps 12 (see FIG. 4) to proceed to the provisional closure of the package 2.

As has been mentioned, the package 2 can be held by transfer means, for example in the manner of plates 7 (see FIG. 2*c* and FIG. 13) which act one at each side of the package 2 approaching each other to flatten it, pleating the lateral folds previously formed and holding it under pressure between the plates 7.

Figure 9A:
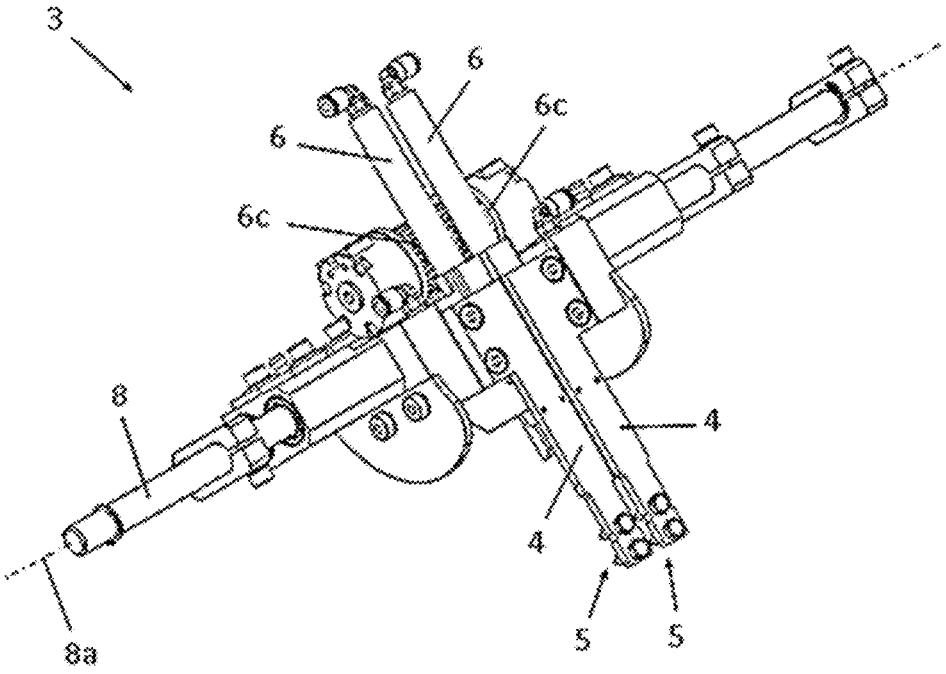
Figure 9B:
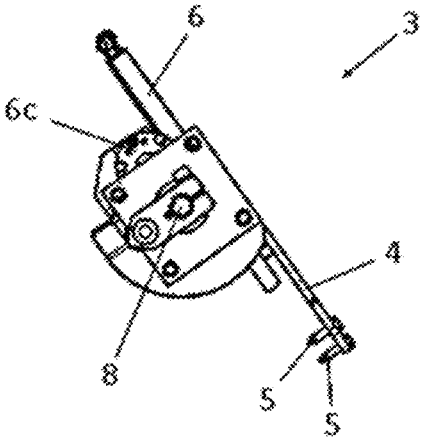

Lastly, once the package has been partially closed and held by means of said plates 7 of the transfer means, the retention means are deactivated to release the captured portions of the package 2, as can be seen in FIGS. 9*a* and 9*b*.

The arms 4 are actuated to return towards the initial position (see FIGS. 5*a* and 5*b*) in which they adopt a substantially horizontal position and they are again separated while said holding clamps 12 are in turn moved away with the aim of receiving a new empty package 2.

In the embodiment described, the retention means 6 are configured by a piece mounted adjacent to the arm 4 and longitudinally displaceable with respect to said arm 4 according to a linear movement between the release position and the captive position and vice versa.

In order to actuate said retention means 6, in this example a transmission 6*c* of the rack and pinion type is used, said displaceable piece of the retention means 6 being provided with a rack which is capable of being moved by means of the actuation of a pinion mounted in the structure of the arm 4 and the pinion being actuated by means of an actuator such as an electric motor.

Figure 10:
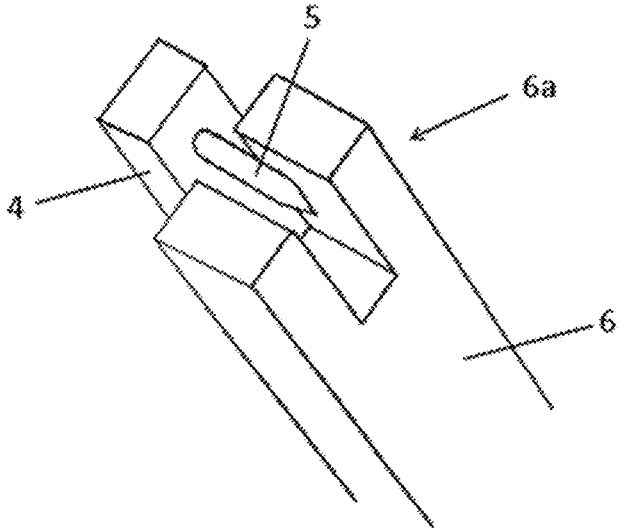
FIGS. 10 and 11 respectively show schematic and perspective views of two different embodiments of the retention means, which act on the gripping tool.
Figure 11:
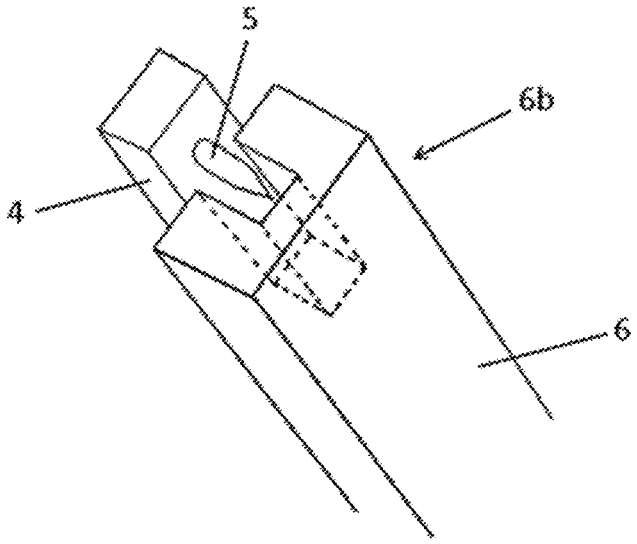

In FIGS. 10 and 11, two embodiments of said retention means 6 can be observed. According to a first embodiment, said retention means 6 comprise a retention end equipped with a through indentation 6*a* in the form of a fork (see FIG. 10), while according to a second embodiment the retention end is equipped with a blind indentation 6*b* (see FIG. 11), both indentations 6*a*, 6*b* being configured for suitably catching the tool or tools 5 of the arm 4 during the captive position. It should be emphasized that in these two embodiments, a single gripping tool 5 is depicted for reasons of clarity.

According to a preferred embodiment, the arms 4 can carry out a composite movement, not strictly rotary around the rotary axis 8, as is explained below.

Figure 12A:
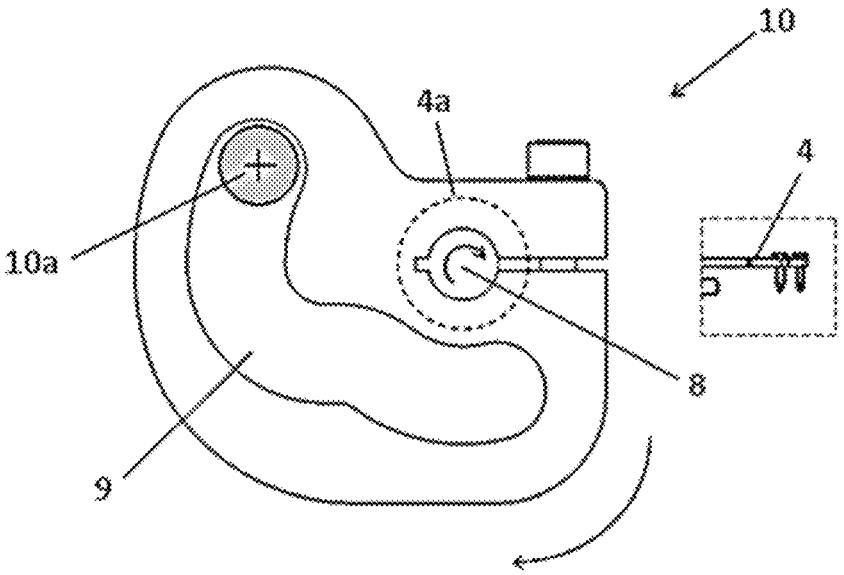
FIGS. 12*a* and 12*b* respectively show two end positions of a cam inseparable in movement with the rotary axis of an arm, capable of transmitting to said rotary axis a guided displacement of the same according to one embodiment of the invention.
Figure 12B:
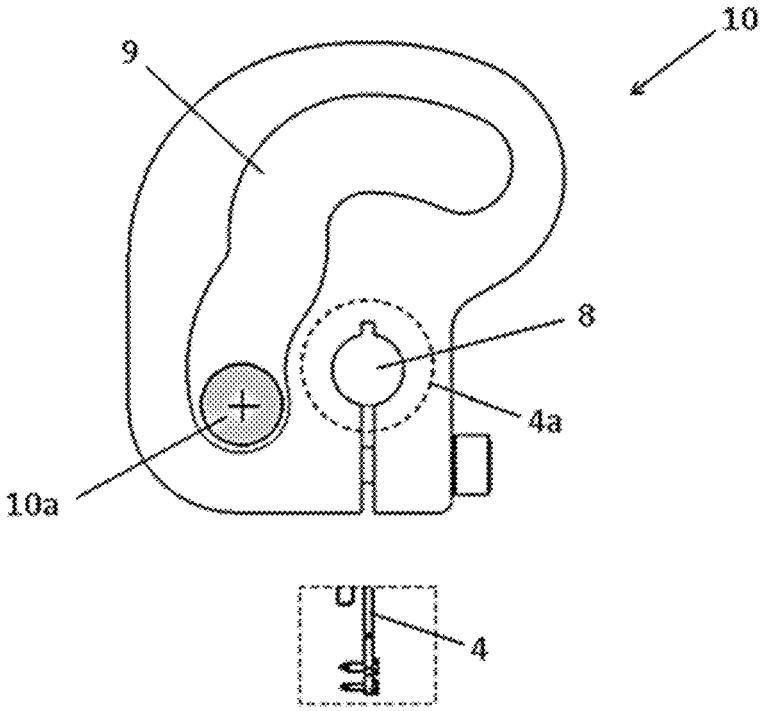

According to a preferred embodiment, in order to carry out said composite movement of the arms 4, a cam 10 is used mounted inseparable in movement with the rotary axis 8 of the arms 4 of each unit 3, as can be observed in FIGS. 12*a* and 12*b*. Said cam 10 is equipped with a sliding rail 9 displaceable on a pivot 10*a* fixed to the chassis of the device 1 or station 100 such that when the rotary axis 8 of the arms 4 rotates, it causes the displacement of the cam 10 by way of the guide 9 thereof, which in turn produces a translation movement of the rotary axis 8 with respect to the fixed pivot 9.

In FIG. 12*a*, the initial position is depicted, corresponding to FIGS. 5*a* and 5*b* in which the arms 4 (partially depicted)

adopt an essentially horizontal position which does not interfere with the horizontal reception path of an empty package 2.

In FIG. 12*b*, the position can be observed, corresponding to FIGS. 6*a* and 6*b*, in which the arms 4 have rotated an angle approximately 90° towards the interior of the package 2 by way of the mouth thereof to expand the walls of the same outwards. In this case, the movement of the cam 10 by way of the guide 9 thereof causes the rotary axis 8 to be displaced outwards with respect to the package, separating the respective arms 4 of both units 3 from each other, which contributes to improving the expansion of the walls of the package 2 during the filling of the same.

In addition, the cam configuration 10 allows the adaptation of the same device 1 to different sizes of packages 2.

Figure 13:
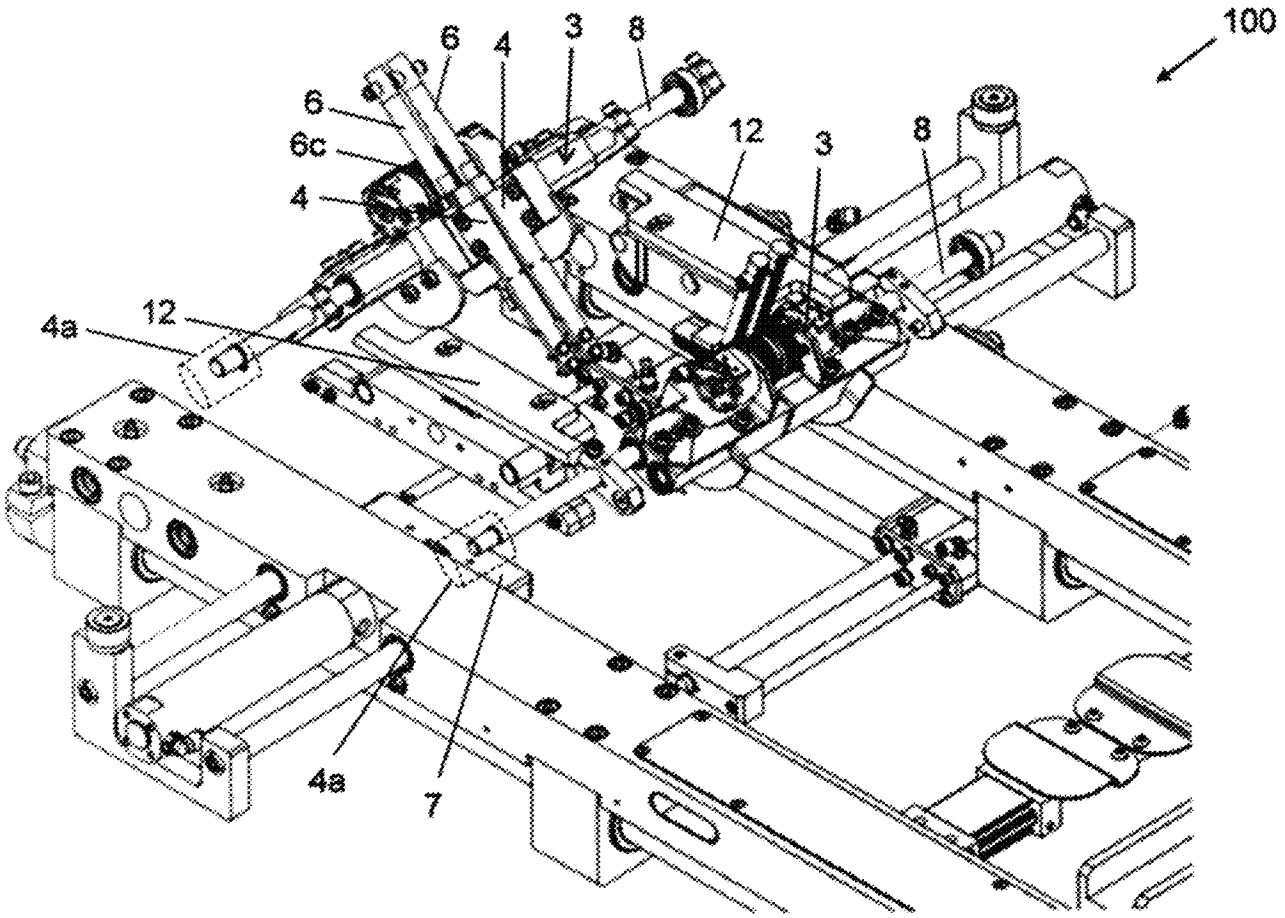
FIG. 13 is a perspective schematic view of a filling and closing station according to one embodiment of the invention.

In FIG. 13, a station 100 for filling and closing a package 2 in a packaging machine can be observed in a simplified manner, in which some components have been removed for greater clarity. In this case, the two drive units 3 opposing each other can be observed with the two pairs of arms 4 arranged in a position corresponding to FIGS. 9*a* and 9*b*.

As has been mentioned, the station 100 comprises two holding clamps 12 capable of approaching or moving away from each other in order to cooperate in a synchronized manner with the movable arms 4 of both units 3 of the device 1 in the filling operations of the package 2 and subsequent closure of the upper edge thereof, and also comprises transfer means provided with two pressing plates 7 arranged one at each side of the package 2 actuatable in order to approach each other and adopt a transfer position, in which they grasp the package 2, flattening it transversally joining opposing walls of the same, preventing the lateral folds formed in the cited package 2 becoming undone and to be displaced together and thus transport the grasped package 2 to one contiguous station of the machine.

Figure 14:
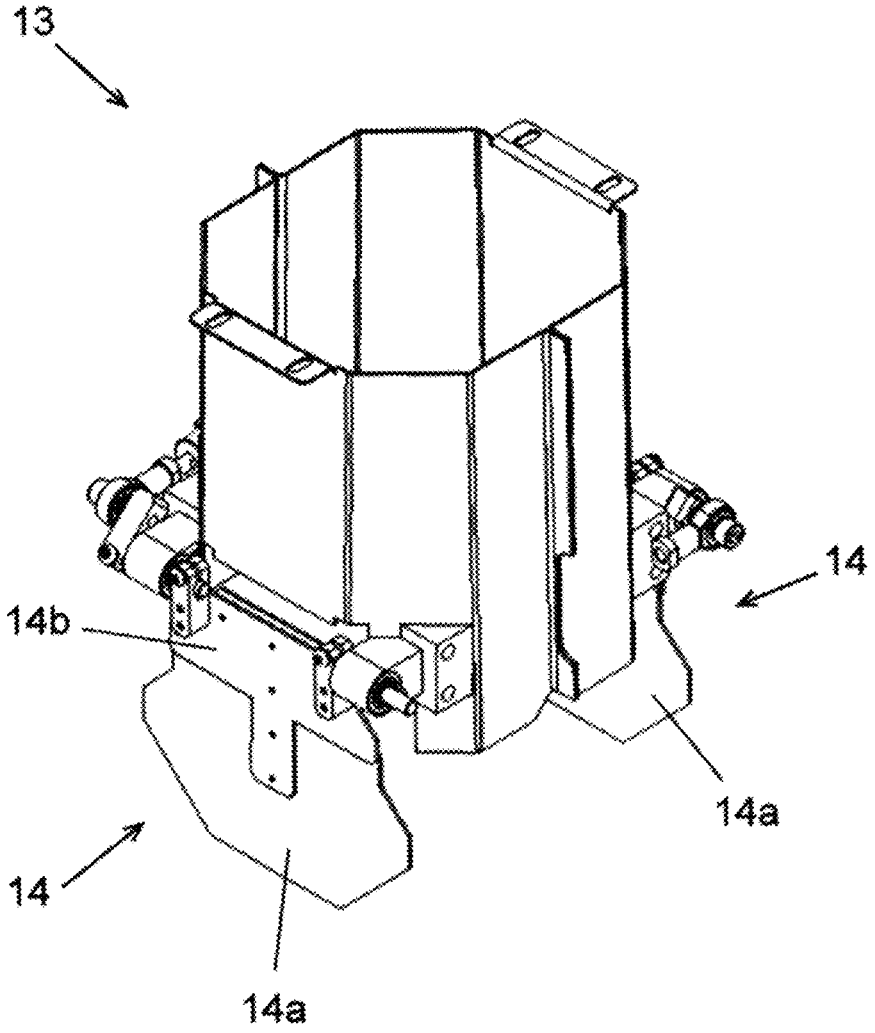
FIG. 14 is a perspective view of a tube for pouring products provided with foldable deflectors.

The station 100 also comprises a tube 13 for pouring products, shown in FIG. 14, which comprises an outlet hole and which is provided with foldable deflectors 14, suited for directing the products poured through the outlet of the tube 13 towards the mouth of the package 2, each deflector 14 being formed by a wing 14*a* of flexible material which is rigidized with a rigid material core 14*b* which extends in a direction parallel to that of the arms 4 of each drive unit 3 of the device 1.

The invention claimed is:

1. A device for assisting in a filling operation and a closing operation of a package which comprises two drive units arranged opposite one another and adapted for receiving an empty package between the two drive units, wherein each drive unit comprises an arm and an actuator group configured to move the arm in a first direction of movement from a first position which does not interfere with the receipt of the package to a second position in which a distal end of the arm is introduced into an interior of the package through a top opening of the package and expands the package by pushing from the interior of the package a corresponding wall of the package outwardly in order to facilitate the filling operation, each arm having or bearing on the distal end at least one gripping tool configured to pass through the corresponding wall of the package and each arm being equipped with retention means for retaining the corresponding wall of the package and configured to be moved between a release position distanced from the gripping tool and a captive position in which the retention means fit over said gripping tool so as to capture or grasp the respective portion of the corresponding wall of the package passed through by the gripping tool, the corresponding actuator group configured to move the arm in a second direction of movement inverse to the first direction, the retention means adopting the captive position, which allows a captured portion of the package to be pulled towards an interior part of the package in order to form respective lateral folds that facilitate correct closure of the package; and wherein the gripping tool for the arm on one of the two drive units extends in a direction away from the gripping tool for the arm on the other of the two drive units when the arms expand the package.

2. The device according to claim 1, wherein the at least one gripping tool is configured as a protuberance configured to pass through a hole of the package.

3. The device according to claim 2, wherein the protuberance has a rod or pointed pin shape.

4. The device according to claim 1, wherein the retention means comprise a piece mounted adjacent to the arm and longitudinally displaceable with respect to the arm according to a linear movement between the release position, distanced from the gripping tool of the arm and the captive position in which the piece fits on said gripping tool to capture or grasp a portion of the package.

5. The device according to claim 4, wherein the piece of the retention means has a retention end, configured to cooperate with the gripping tool for retaining a the portion of the package, equipped with an indentation or depression in which the corresponding gripping tool is at least partially introduced when the piece adopts the captive position.

6. The device according to claim 1, wherein the retention means are actuated by an actuator inseparable from the arm equipped with the retention means.

7. The device according to claim 1, wherein the arm of each drive unit is rotatable about a respective rotary axis such that the arm of each drive unit is configured to swivel around said respective rotary axis simultaneously with the arm of the other drive unit in the first direction of movement and then in the second direction of movement of an operative cycle of the device, and wherein the respective rotary axes of the drive units are parallel to each other.

8. The device according to claim 7, wherein the rotary members are displaceably supported, but in a guided manner, on each drive unit by mechanical support on a guide or surface of a cam, the rotation about the respective axis causes the displacement thereof on the guide or over the cam, in a manner which generates a composite movement on the arms, specifically rotating around an axis which is displaced.

9. The device according to claim 7, wherein each drive unit comprises a second arm coupled to the respective rotary member with the capacity to displace along a section of the respective rotary member, both arms being capable of being displaced simultaneously in opposing directions, approaching and moving away from each other, the operative cycle of the device.

10. The device according to claim 9, wherein the two arms of the same drive unit are connected to each other by an element with elastic properties which acts under compression such that, departing from an initial position in which the arms of the same drive unit are separated a predetermined distance, when these are actively pulled in opposite directions, approaching each other, the element with elastic properties is compressed and once said pulling ceases to be exerted on the arms, both arms are automatically separated as the element with elastic properties tends to recover the original shape thereof.

11. The device according to claim 1, wherein the package is a flexible tubular net.

12. The device according to claim 6, wherein the actuator for the retention means is electric or pneumatic.

13. A station for filling and closing a package in a packaging machine, which comprises a device according to claim 1; and a pair of holding clamps configured for holding an empty package suspended, said clamps being capable of approaching or moving away from each in order to cooperate in a synchronized manner with the movable arms of both drive units of the device in the operations of filling the package and subsequently closing the upper edge thereof, the station also comprising transfer means with two pressing plates arranged one at each side of the package actuatable in order to approach each other and adopt a transfer position, in which pressing plates grasp the package, flattening the package by transversally joining opposing walls of the package, preventing the lateral folds formed in the package from becoming undone and in order to be displaced together and thus transport the grasped package to a contiguous station of the machine, said pressing plates being placed and dimensioned such that in the transfer position they interfere with the path of the arms from the initial position thereof until the position in which, introduced in the package, they push the walls of the same to expand it.

14. The station for filling and closing according to claim 13, further equipped with a tube for pouring products with an outlet hole and provided with foldable deflectors suited for directing the products poured through the outlet of the tube towards the mouth of the package, each deflector being formed by a wing of flexible material which is rigidized with a rigid material core which extends in a direction parallel to that of the arms of each drive unit of the device.

15. The method according to claim 13, wherein the package is a flexible tubular net.

16. A device for assisting in a filling operation and a closing operation of a package, comprising:

two drive units arranged opposite one another and adapted for receiving an empty package between the two drive units, each drive unit comprises an arm and an actuator group configured to move the arm in a first direction of movement from a first position above a top opening of the package to a second position in which a distal end of the arm is introduced into an interior of the package through the top opening of the package and expands the package by pushing from the interior of the package a corresponding wall of the package outwards to expand the package in order to facilitate the filling operation, such that, with the package positioned below the distal end of the arm, said first direction of movement of the arm causes the distal end of the arm to be repositioned from a first height above the top opening of the package to a lower height at the second position interior of the package;

wherein a distal end of each arm is associated with a gripping tool adapted to pass through the corresponding wall of the package;

wherein each arm is equipped with a clamp for retaining the corresponding wall of the package and that is configured to be moved between a release position distanced from the gripping tool and a captive position cooperating with the gripping tool so as to capture a respective portion of the corresponding wall of the package attached to the gripping tool, the corresponding actuator group configured to move the arm in a second direction of movement inverse to the first direction, such that the clamp in the captive position allows the captured portion of the package to be pulled towards an interior part of the package in order to form respective lateral folds that facilitate correct closure of the package.

17. The device according to claim 16, wherein the first direction of movement is down and away from a centerline of the opening of the package and the second direction of movement is up and towards the centerline of the opening of the package.

18. The device according to claim 16, wherein the gripping tool for the arm on one of the two drive units extends in a direction away from the gripping tool for the arm on the other of the two drive units when the clamp is in the captive position, such that each gripping tool is configured to pass through the corresponding wall of the package from the interior of the package to expand the package.

* * * * *